US007824522B2

(12) United States Patent
Alf

(10) Patent No.: US 7,824,522 B2
(45) Date of Patent: Nov. 2, 2010

(54) HEADBOX SLICE BEAM REMOVAL SYSTEM AND DEVICE

(75) Inventor: Larry John Alf, Edgerton, WI (US)

(73) Assignee: Metso Paper, Inc., Helsinki (FI)

( * ) Notice: Subject to any disclaimer, the term of this patent is extended or adjusted under 35 U.S.C. 154(b) by 225 days.

(21) Appl. No.: 12/210,488

(22) Filed: Sep. 15, 2008

(65) Prior Publication Data

US 2010/0065239 A1 Mar. 18, 2010

(51) Int. Cl.
*D21F 1/32* (2006.01)

(52) U.S. Cl. ..... 162/199; 162/272

(58) Field of Classification Search ..... 162/199, 162/272

See application file for complete search history.

(56) References Cited

U.S. PATENT DOCUMENTS 6,033,527 A 3/2000 Waech et al.

*Primary Examiner*—Mark Halpern
(74) *Attorney, Agent, or Firm*—Stiennon & Stiennon

(57) ABSTRACT

An apparatus for the repair or maintenance of a papermaking headbox has two devices, one of which is used on the tending side and one of which is used on the drive side of the headbox. Each device has three parts, a lower bracket mounted to the headbox frame, an upper bracket mounted to the headbox slice beam, and a carriage which moves on a track formed on the lower bracket. The carriage is adjustably mounted to the upper bracket, and supports the slice beam which is attached to the upper bracket, and allows the slice beam to be precisely raised and lowered with respect to the headbox, so as to disconnect the slice beam from the headbox. Once separated, the slice beam is moved on the track, displacing it in the machine direction from the head box.

5 Claims, 3 Drawing Sheets

HEADBOX SLICE BEAM REMOVAL SYSTEM AND DEVICE

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a papermaking headbox in general, and tools to assist with the assembly and disassembly of the headbox in particular.

In a papermaking machine, fibers such as wood fibers are suspended in a dilute suspension in water and supplied onto a single forming fabric, or between two forming fabrics such that a paper web is formed. The web formed is first dewatered in a forming section and further dewatered through pressing in a pressing section, followed by final dewatering in a dryer section by application of the heat generated by steam heated dryer rolls. Critical to the overall quality of the web of paper or board formed in the papermaking machine is the condition of the fibers as they are supplied to the forming section. Ideally the fibers are evenly distributed in a cross machine direction extending across the width of the web, and are deposited before the fibers have a chance to clump together. To accomplish these goals sophisticated devices known as headboxes supply to the fabric or fabrics an even jet of stock composed of water, fibers and various additives.

Carefully formulated fiber stock is supplied to a header in the headbox which evenly distributes the stock in the cross machine direction to a flow channel which leads to a slice chamber and then to a slice opening which discharges on to the forming fabric(s) in the forming section. As the stock proceeds from the inlet header it typically passes through a turbulence generator and then into a converging slice chamber to the narrow slice opening formed by slice lips. A jet of stock closely matching the velocity of the forming fabric(s) exits the headbox through the slice lips and flows onto the forming fabric(s). The upper portion of the slice chamber is formed by a beam hingedly mounted by a knuckle to the headbox. Periodically during machine maintenance it is necessary to remove the slice beam from the headbox for cleaning and inspection.

Because of the high cost of ownership of the papermaking machine, such machines are typically operated as nearly continuously as possible. Scheduled maintenance throughout the machine is simultaneously performed at certain intervals to avoid unscheduled shutdowns. During scheduled maintenance the availability of overhead crane(s) for moving heavy objects is limited by the competing needs of the various sections of the papermaking machine which also require use of an overhead crane. Typically the slice beam, which can weigh in the neighborhood of 20,000 pounds, requires the availability of a crane for its removal and reinstallation to the headbox. Furthermore, the slice beam normally contains a large number of electrical or hydraulic actuators which shape the slice lip to control small-scale variations in the paper web produced. Complete removal of the slice beam requires disconnecting and reconnecting numerous control and power lines. What is needed is a system for removing and reinstalling the headbox slice beam with minimum use of the overhead crane, and which avoids the necessity of disconnecting the slice lip control connections.

SUMMARY OF THE INVENTION

The slice beam transport device of this invention has two devices, one of which is used on the tending side and one of which is used on the drive side of the headbox. Each device has three parts, a lower bracket mounted to the headbox frame, an upper bracket mounted to the headbox slice beam, and a transport bracket or carriage which has wheels which allow the carriage to roll on a track formed on the lower bracket. The transport bracket is adjustably mounted to the upper bracket, and supports the upper bracket and the slice beam which is attached to the upper bracket, and allows the slice beam to be precisely raised and lowered. Once the two devices are in place and supporting the slice beam, the slice beam knuckle by which the slice beam is pivotally mounted to the headbox is detached from a knuckle socket by removing a knuckle clamp and the slice beam is lowered by approximately 200 thousandths of an inch (0.2 inches). The slice beam is then moved horizontally on the order of 6 inches to gain access to the slice beam knuckle for maintenance and repair.

It is a feature of the present invention to provide a device for reducing the labor associated with separating the slice beam from the headbox.

It is another feature of the present invention to provide a device which reduces the use of overhead crane facilities during headbox repair and maintenance.

Further objects, features and advantages of the invention will be apparent from the following detailed description when taken in conjunction with the accompanying drawings.

DESCRIPTION OF THE PREFERRED EMBODIMENTS

Figure 1:
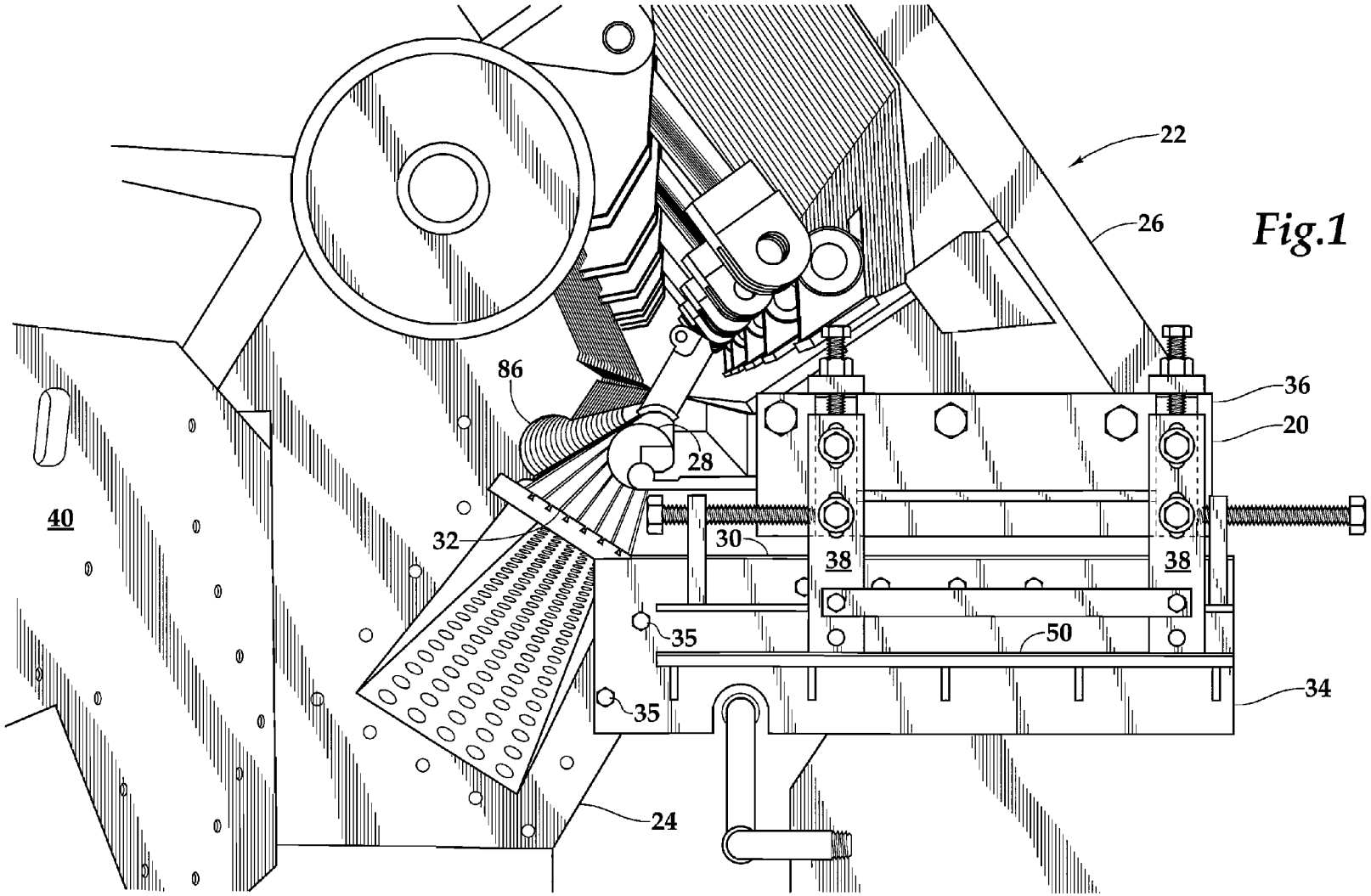
FIG. 1 is a perspective side view of the headbox on which the slice beam transport device of this invention is mounted.
Figure 3:
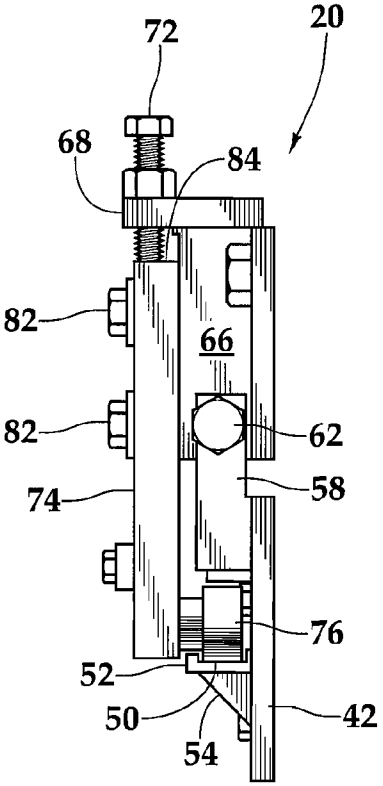
FIG. 3 is a front elevational view of the slice beam transport device of FIG. 1.
Figure 2:
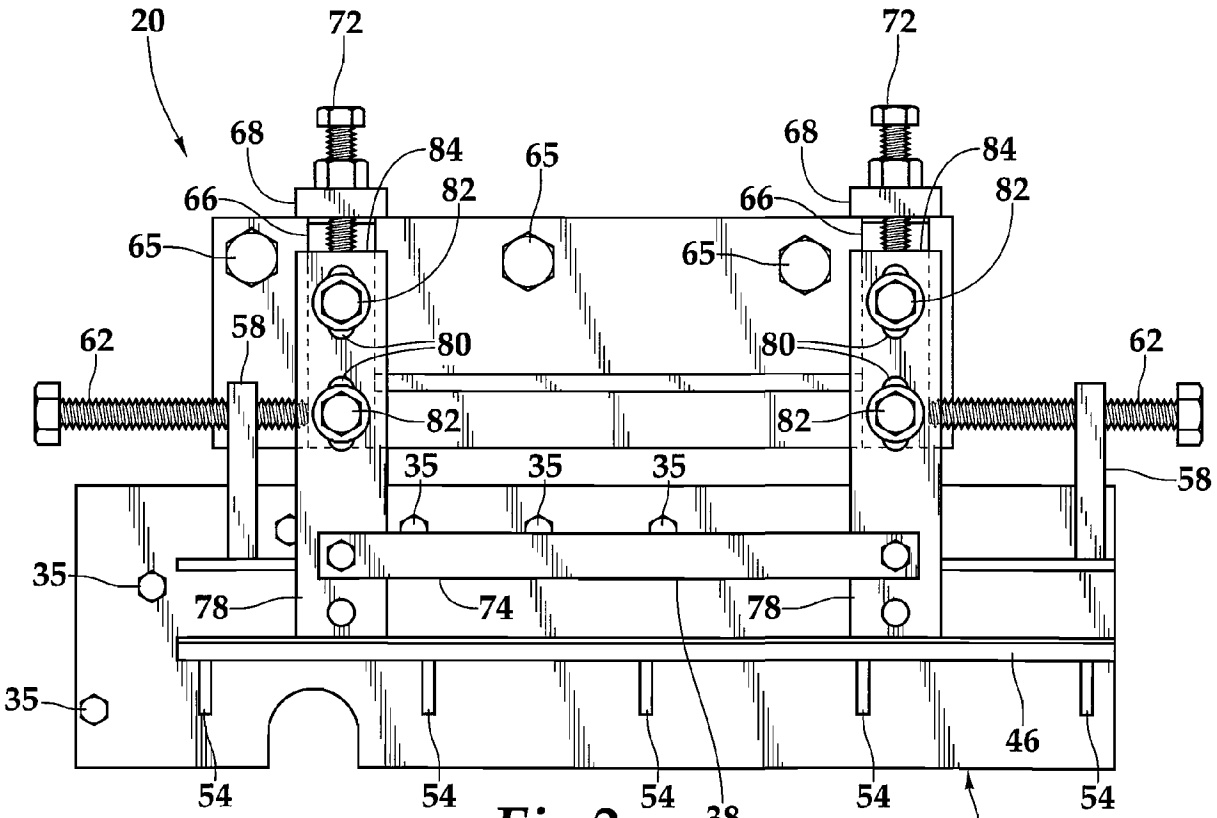
FIG. 2 is a side elevational view of the slice beam transport device of FIG. 1.
Figure 4:
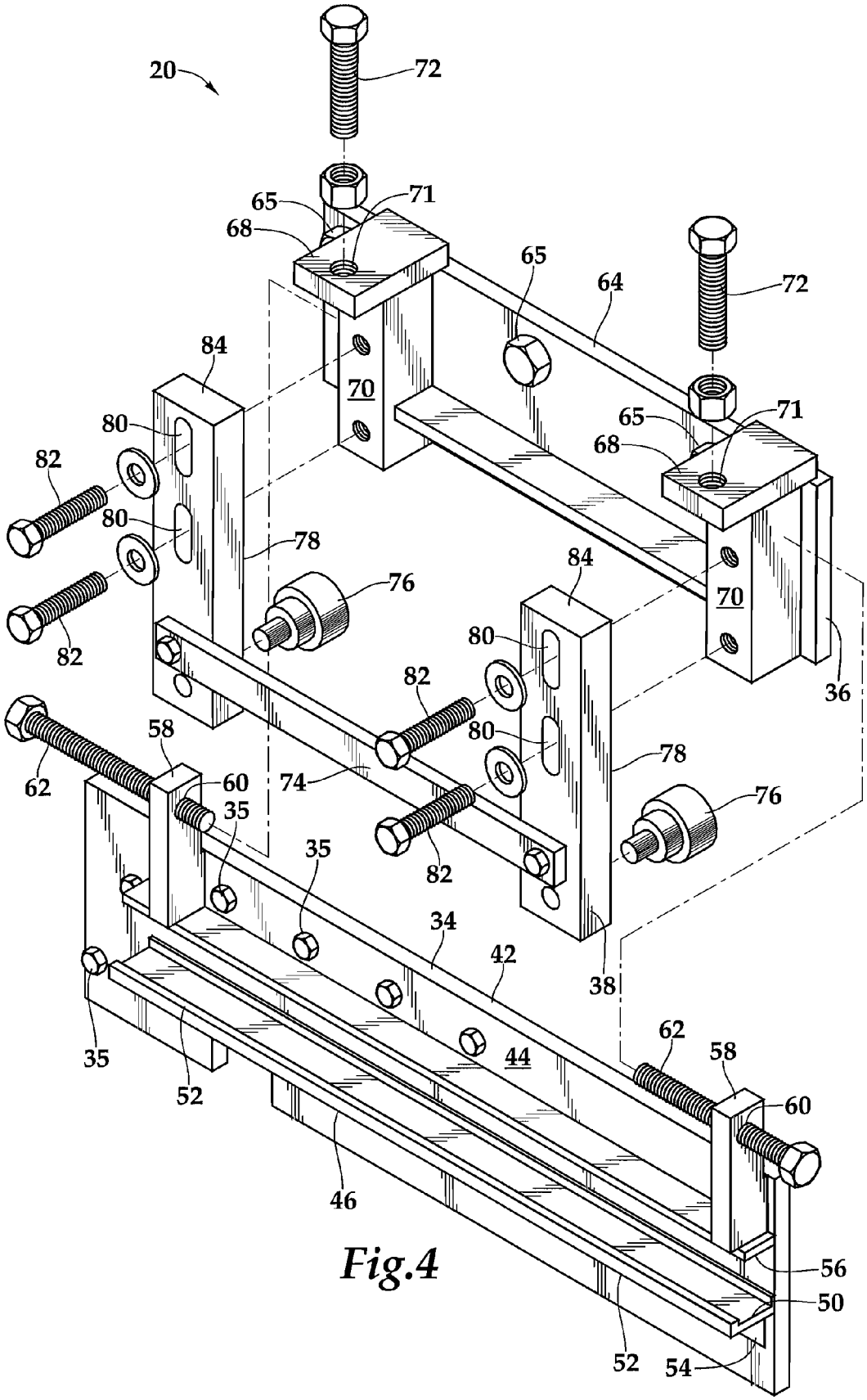
FIG. 4 is a exploded isometric view of the slice beam transport device of FIG. 1.

Referring more particularly to FIGS. 1-4, wherein like numbers refer to similar parts, a headbox slice beam transport device 20 is shown mounted to the tending side of a BELOIT® Concept III headbox 22 available from Metso Paper, Inc. A mirror image device (not shown) is mounted to the drive side of the headbox 22. The headbox 22 has a frame 24 and a slice beam 26 joined to the frame 24 at a knuckle 28 which forms a pivot between the slice beam 26 and the bottom wall 30 of the slice chamber 32.

Each slice beam transport device 20 has three parts, as shown in the FIGS. 1-4, a lower bracket 34 mounted to the slice box frame 24 and bottom wall 30. An upper bracket 36 mounted to the head box slice beam 26, and a transport bracket 38 which allows the slice beam 26 to move on the lower bracket 34.

The lower bracket 34 is fastened by bolts 35 into the headbox 22. The lower bracket 34 has a face plate 42 which is bolted to the headbox frame 24 and bottom wall 30 using existing bolt holes. The existing bolt holes, when the transport device is not in use, receive bolts which extend through a removable end plate 40 of the headbox 22, and hold the end plate in place. A first flange or horizontal beam 46 which extends along the headbox 22 toward the slice opening 48 in the machine direction is welded onto the tending side face 44 of the face plate 42. The upper surface of the beam 46 forms a horizontal track 50 which has a raised lip 52 which further defines the flat bottomed shallow upwardly opening U-shaped horizontal track. The track 50 is supported by underlying triangular gussets 54. Overlying the track is a second flange 56 arranged to capture wheels running on the track 50.

Mounted to the second flange 56 on either end of the lower bracket 34 are upstanding posts 58 which are welded to the second flange 56 and to the face plate 42 along the tending side face 44. The upstanding posts 58 extend above the face plate 42 and each upstanding post has a machine direction threaded hole 60 in the portion of the posts 58 which extends above the face plate 42. In each threaded hole is a positioning bolt 62 which can be used to cause lateral movement of the slice beam 26 by pressing on the upper bracket 36.

The upper bracket 36 has a face plate 64 which is fastened by bolts 65 to the slice beam 26 using existing tapped holes in the slice beam 26. The upper bracket 36 has two upwardly extending vertical flanges 66 welded to the face plate 64. The vertical flanges 66 are engaged by the positioning bolts 62 of the lower bracket 34 to move the upper bracket 36. Each vertical flange 66 has a welded top member 68 which has portions which extend beyond a vertical flange in the cross machine direction away from the tending side a short distance. Each top member 68 has a vertical threaded hole 71 in which a bolt 72 is arranged to move up and down parallel to the face plate 64 and a front face 70 of each vertical flange 66.

The third part of the slice beam transport device 20 is the transport bracket or carriage 38 having a frame 74 on which two wheels 76 are mounted for rotation. The wheels 76 are arranged to roll in the track 50 of the lower bracket 34. The frame 74 has two vertical support member 78 to each of which one of the wheels 76 is mounted. Each vertical support member 78 has two vertically slotted bolt holes 80 through which bolts 82 clamp the vertical support member to one of the vertical flanges 66 of the upper bracket 36. The clamping between the vertical support members 78 and the vertical flanges 66 holds them in parallel relation but allows for vertical motion under the effect of the weight of the slice beam. Each vertical support member 78 is terminated by an upwardly facing upper surface 84. The bolts 72 extend downwardly from the top members 68 of the upper bracket 36 and engage the support member 78 upper surfaces 84. Rotation of the bolts 72 moves the upper support bracket 36 with respect to the transport bracket 38, rasing and lowering the upper bracket 36 and the attached slice beam 26. The slotted bolt holes 80 allow slight vertical movements of the transport bracket 38 with respect to the upper bracket 36 even as the vertical support members 78 on the transport bracket 38 are clamped to the vertical flanges 66 of the upper bracket.

To move the slice beam in the machine direction to separate the knuckle 28 from the headbox 22, an upper bracket 36 is bolted to the tending and to the drive side of the slice beam 26, and the lower brackets 34 are bolted to the tending and drive sides of the headbox 22. Transport bracket 38 are installed so the wheels 76 of the carriages engage the tracks 50 on the lower brackets 34 and the vertical support members 78 are bolted to the vertical flanges 66 of the upper brackets 36. Then by turning the vertical adjustment bolts 72, the slice beam 26 is supported on the carriages 38. When the slice beam 26 is thus supported, the headbox knuckle clamp (not shown) is removed, and the slice beam knuckle 28 is lowered out of the knuckle socket 86 in the headbox by backing off the vertical adjustment bolts 72 approximately 200 thousandths of an inch, lowering the slice beam free of the knuckle socket. The slice beam 26, now supported on the carriages 38, can be moved forward in the machine direction by using the positioning bolts 62 on the lower brackets 34 to move the slice beam approximately 6 inches in the machine direction along the tracks 50 of the lower brackets. The process is reversed to install the slice beam. Controlled motion is effected using the opposed bolts 62 wherein one pair of bolts is rotated to advance the slice beam in a machine direction, and a second opposed pair of bolts is rotated and retracted to allow said motion and vice versa.

The slice beam transport devices 20 is advantageous in that when the papermaking machine is down for maintenance an overhead crane is required only for a short time to install and remove the slice beam transport device. Thus the overhead crane is made available for other maintenance jobs. Furthermore, when the beam transport device 20 is used to provide precise and accurate control over movement of the slice beam 26, it is not necessary to disconnect the slice lip control hoses and wires.

It should be understood that the slice beam transport device 20 may be adapted to a wide range of headboxes, with the precise structural arrangement varying in accordance with the necessity of a particular headbox design. The essential components are three brackets: one mounted to the headbox, one to the slice beam, and one that allows a small vertical motion and a relatively large horizontal movement therebetween. The third bracket can be more or less incorporated into one of the first or second brackets.

It should be understood that the term bolt or bolts as used herein generally refers to fasteners having a threaded shank and a bolt head which facilitates rotation of the threaded shank, such as also referred to as screws, but also includes a threaded rod combined with one or more threaded nuts.

It should be understood that preferably no modifications to the headbox or the slice beam is required, rather existing bolt holes or structures are used for mounting the upper bracket 36 to the slice beam and the lower bracket 34 to the headbox.

It is understood that the invention is not limited to the particular construction and arrangement of parts herein illustrated and described, but embraces all such modified forms thereof as come within the scope of the following claims.

I claim:

1. A method of separating a slice beam from a headbox to which the slice beam is mounted, the headbox having a bottom wall, and the slice beam and the bottom wall defining a slice chamber therebetween, comprising the steps of:

removing a tending side end cover from the headbox to expose portions of the headbox and the slice beam defining tending side threaded bolt holes used to attach the tending side end cover;

removing a drive side end cover from the headbox to expose portions of the headbox and the slice beam defining drive side threaded bolt holes used to attach the drive side end cover;

fastening a tending side first bracket to the headbox by extending bolts into a first plurality of the tending side threaded bolt holes below the slice chamber;

fastening a drive side first bracket to the headbox by extending bolts into a first plurality of the drive side threaded bolt holes below the slice chamber;

bolting a tending side second bracket to a second plurality of the tending side threaded bolt holes in the slice beam;

bolting a drive side second bracket to a second plurality of the drive side threaded bolt holes in the slice beam;

mounting a transport bracket between the tending side first bracket and the tending side second bracket, to support the slice beam with respect to the headbox;

mounting a drive side transport bracket between the drive side first bracket and the drive side second bracket, to support the slice beam with respect to the headbox;

freeing the slice beam for vertical and horizontal motion with respect to the headbox;

lowering the slice beam toward the bottom wall by vertically adjusting the relative position of the first brackets with respect to the transport brackets; and transporting the slice beam horizontally in a downstream machine direction away from the headbox by a sliding motion of the transport brackets on the first brackets.

2. The method of claim 1 wherein the slice beam is lowered towards the bottom wall by about 200 thousands of an inch, followed by a movement of the slice beam in the horizontal downstream machine direction of on the order of 6 inches.

3. The method of claim 1 wherein the horizontal downstream machine direction motion of the slice beam is effected by adjustment of opposed bolts mounted to the first brackets, wherein a pair of bolts on the first brackets are rotated to advance the slice beam in a machine direction, and a second pair of opposed bolts on the first brackets are rotated and retracted to allow said motion.

4. The method of claim 1 wherein the vertical motion is effected by retracting vertically positioned bolts threadedly engaged with said second brackets which extend downwardly to engage portions of said transport brackets to provide vertical support of the slice beam with respect to said transport brackets.

5. The method of claim 1 wherein the foregoing steps are reversed to reassemble the slice beam to the headbox, and wherein the slice beam remains connected to the headbox by pneumatic or electrical control lines before, during, and after said foregoing steps.

* * * * *